US005775216A

United States Patent [19]

Rouleau

[11] Patent Number: 5,775,216

[45] Date of Patent: Jul. 7, 1998

[54] GOLD BLOCKING PRESS TYPE PRINTING MACHINE

[75] Inventor: Pierre Rouleau, Oyonnax, France

[73] Assignee: Societe d'Exploitation Des Machines Dubuit, Noisy Le Grand, France

[21] Appl. No.: 634,805

[22] Filed: Apr. 19, 1996

[30] Foreign Application Priority Data

Apr. 21, 1995 [FR] France ..... 95 04844

[51] Int. Cl.[6] ..... B44C 1/14; B44B 5/00

[52] U.S. Cl. ..... 101/27; 101/9; 101/10; 101/DIG. 31

[58] Field of Search ..... 101/27, 31, 9, 101/21, 5, 8, 10, DIG. 31

[56] References Cited

U.S. PATENT DOCUMENTS

| | | | |
|---|---|---|---|
| B 562,813 | 2/1976 | King | 425/384 |
| 1,204,578 | 11/1916 | Lyon | 101/5 |
| 2,248,207 | 7/1941 | Tedder | 101/31 |
| 3,097,592 | 7/1963 | Friedman | 101/8 |
| 3,815,494 | 6/1974 | Bahnmuller | 101/27 |
| 4,196,664 | 4/1980 | Crasnianski | 101/27 |
| 4,928,588 | 5/1990 | Mathis | 101/9 |

FOREIGN PATENT DOCUMENTS

| | | | |
|---|---|---|---|
| 2071119 | 8/1971 | France | B41K 3/00 |
| 2691671 | 5/1992 | France | B41F 17/18 |

*Primary Examiner*—Edgar S. Burr
*Assistant Examiner*—Leslie Grohusky
*Attorney, Agent, or Firm*—Young & Thompson

[57] ABSTRACT

A printing machine includes, like a gold blocking press, a printing plate mobile relative to an object support to apply to an object to be printed a foil appropriate to the required printing. The printing plate is curved when in contact with a support block mounted so that it can rock on an applicator head mobile transversely to the object support. Applications of the printing machine include printing on flat objects.

12 Claims, 2 Drawing Sheets

GOLD BLOCKING PRESS TYPE PRINTING MACHINE

BACKGROUND OF THE INVENTION

FIELD OF THE INVENTION

The present invention concerns printing machines of the kind including, like a gold blocking press, a printing plate with a raised pattern on it corresponding to the matter to be printed and that is mobile relative to an object support, to apply to the object to be printed a foil appropriate to the required printing.

It is more particularly, but not necessarily exclusively, concerned with the situation in which the object to be printed is flat.

To obtain the required printing the printing plate must be heated and it must apply a foil to the object to be printed with sufficient contact pressure.

If the printing plate is flat it is relatively easy to heat it by means of a heater plate applied to its back.

However, as it is applied simultaneously to all of the surface of the object to be printed, to obtain a given contact pressure a high force must be applied to it.

For larger surface areas this force becomes prohibitive.

To reduce the force for a given contact pressure, it has been proposed to wrap the printing plate around and in contact with a cylinder rotatable relative to the object support so that at any time it is in contact with the object to be printed only along a line on the latter, through one generatrix.

However, in this case relative displacement of the cylinder carrying the printing plate and the object support is required for the corresponding contact generatrix to be swept across all of the surface of the object to be printed.

It is then difficult to heat the printing plate.

It is usually necessary to provide a heater bell around the cylinder, with relatively costly constructional complications and the attendant risk of seizing of the cylinder bearings.

A general object of the present invention is to overcome these problems in a relatively simple way.

SUMMARY OF THE INVENTION

The invention consists in a printing machine including, like a gold blocking press, a printing plate mobile relative to an object support to apply to an object to be printed a foil appropriate to the required printing, wherein said printing plate is curved when in contact with a support block mounted so that it can rock on an applicator head mobile transversely to said object support.

This construction has the advantage of being relatively simple from the mechanical point of view, requiring only a flat, and therefore relatively simple, heater plate to heat the printing plate.

The features and advantages of the invention will emerge from the following description given by way of example with reference to the appended diagrammatic drawings.

DETAILED DESCRIPTION OF THE PREFERRED EMBODIMENT

Figure 1:
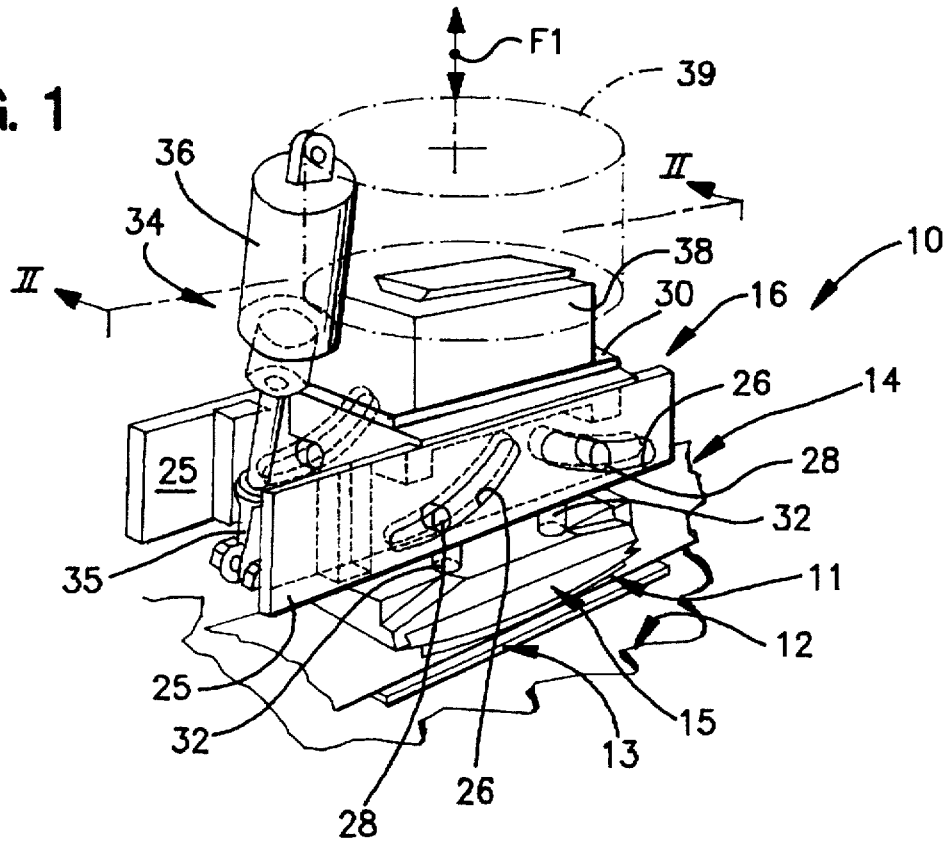
FIG. 1 is a perspective view of a printing machine in accordance with the invention.

As shown in the figures, the printing machine 10 of the invention includes in a manner that is known in itself, and like a gold blocking press, a printing plate 11 mobile relative to an object support 12 to apply to an object 13 to be printed a foil 14 appropriate to the required printing.

In accordance with the invention, the plate 11 is curved when in contact with the support block 15 which, as described in more detail below, is mounted on an applicator head 16 so that it can rock, like a hand blotter, and the applicator head 16 is mobile transversely to the object support 12, as shown by the straight double-headed arrow F1 in FIGS. 1 and 2.

In the embodiment shown, the object 13 to be printed is a flat object, the object support 12 is itself therefore flat, and the plate 11 is in two parts fastened together, for example glued together, namely an outer part 11A made from a synthetic material, for example, with a raised pattern on it defining the matter to be printed and an inner part 11B made from metal, for example, and by means of which the combination is attached to the support block 15 by screws 17.

The surface 18 of the support block 15 with which the curved plate 11 is in contact is in practise a cylindrical surface of circular cross-section with its generatrices parallel to the object support 12.

The plate 11 can, of course, be initially flat, becoming curved only when fitted to the support block 15.

Alternatively, it can be made to have the same profile as the surface 18 of the support block 15 from the outset.

In the embodiment shown the support block 15 includes a heater plate 20 that is in two parts joined together, for example by means of a dovetail type joint 21 as shown here, namely a removable part 22 that carries the printing plate 11, and that therefore defines the surface 18, and a fixed part on the back of the removable part 22, and that forms the heater plate 20.

In the embodiment shown the heater plate 20 is flat.

Figure 2:
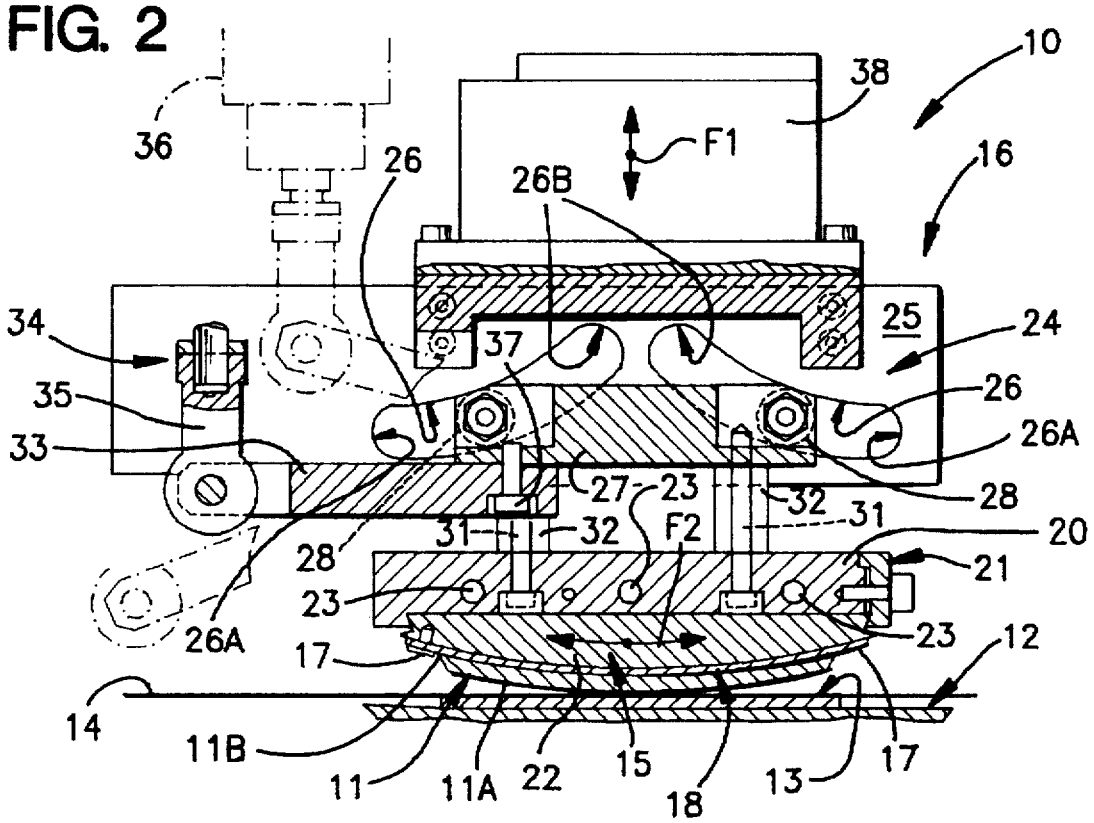
FIG. 2 is a view of the machine in longitudinal section on the line II—II in FIG. 1.
Figure 3:
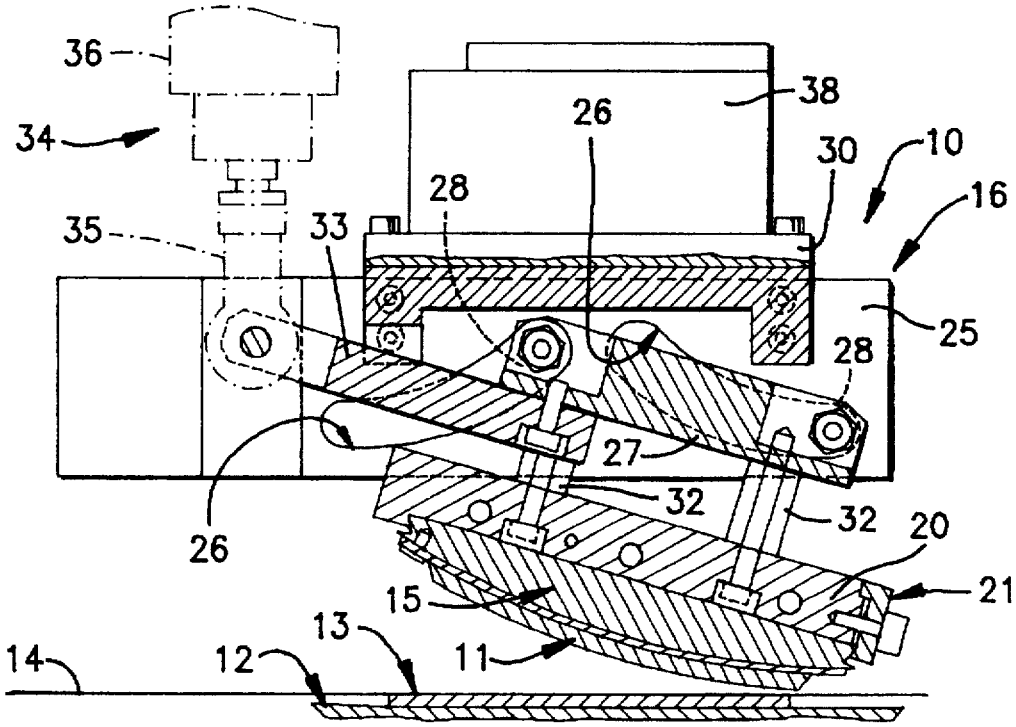
FIGS. 3 and 4 illustrate the support block and printing block in their limiting positions corresponding to the double-headed arrow F2 in FIG. 2.
Figure 4:
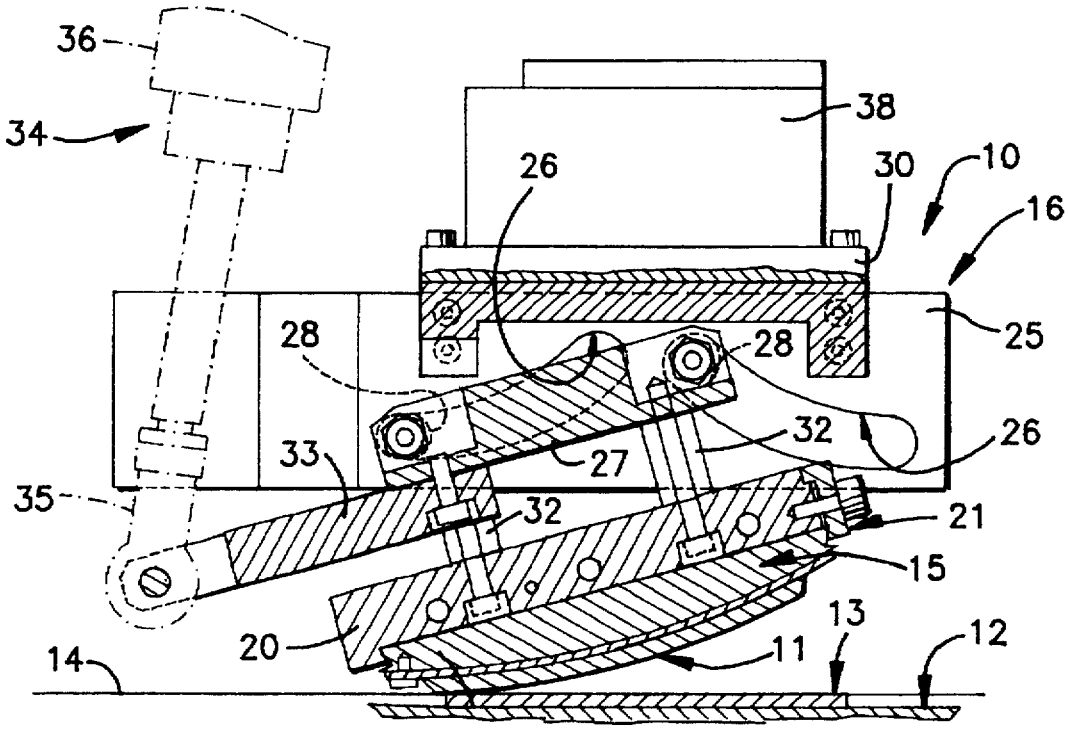

FIG. 2 shows spaced resistive heater elements 23 extending through it.

Guide means 24 providing the required rocking mounting are disposed between the support block 15 and the applicator head 16.

In the embodiment shown the guide means 24 include two parallel flanges 25 on the applicator head 16 between which the support block 15 moves and each of which includes two spaced curved slots 26; the guide means 24 further include, rotatably mounted on a plate 27 to which the support block 15 is attached, two pairs of rollers 28 each of which is engaged with one of the slots 26 in the flanges 25.

The flanges 25 are braced at the top by a crossmember 30.

The two slots 26 in each of them are disposed back-to-back, with their concave side facing away from the object support 12.

Thus the two slots 26 converge from a lower end 26A at which they are relatively far apart and relatively close to the object support 12 to an upper end 26B at which they are relatively close together and relatively far from the object support 12.

The slots 26 are symmetrical about a median plane perpendicular to the object support 12 and to the flanges 25 and their shape can be determined empirically, point by point.

Each is the general shape of a cycloid type curve. This feature is familiar to the person skilled in the art and is not described further here.

The support block 15 for the printing plate 11 is joined to the plate 27 by tie rods 31 each of which is partly surrounded by a bush 32 forming a spacer between the support block 15 and the plate 27.

An arm 33 attached to the support block 15 for the printing plate 11 is coupled to a double-acting cylinder 34 mounted so that it can oscillate on the applicator head 16.

As shown here, for example, the piston 35 of the double-acting cylinder 34 is articulated to the arm 33 and its body 36 is articulated to the applicator head 16.

A converse arrangement is obviously feasible, and in both cases the articulation axes are parallel to the generatrices of the surface 18 of the support block 15 to which the printing plate 11 is applied.

In the embodiment shown the arm 33 is attached to the plate 27 by screws 37.

A superstructure 38 of the applicator head 16 carried by the crossmember 30 is attached to a piston 39, shown in chain-dotted outline in FIG. 1, of a press of the usual type, to reciprocate it relative to the object support 12 and to apply the force necessary to produce the required contact pressure.

As this arrangement is conventional in the art, it is not described in more detail here.

When the piston 39 causes the support block 15 for the printing plate 11 to apply the foil 14 to the object 13 to be printed on the object support 12, actuation of the double-acting cylinder 34 rocks the support block 15, as shown by the curved double-headed arrow F2 in FIG. 2, and therefore rolls the plate 11 along the object 13 to be printed, with the foil 14 between them.

During this rocking the rollers 28 at one end of the plate 27 run along their slots 26 from the lower end 26A of the latter to their upper end 26B, while the rollers 28 at the other end of the plate 27 run along their slots 26 from the upper end 26B of the latter to their lower end 26A.

With the rocking type mounting of the invention, the instantaneous rotation axis about which the support block 15 for the plate 11 pivots as it rocks is an imaginary axis, differing in this regard from a rotary type mounting.

In other words, the instantaneous rotation axis is a virtual axis.

FIG. 1 shows in chain-dotted line the corresponding extreme positions of the piston 35 of the double-acting cylinder 34.

Of course, the present invention is not limited to the embodiment described and shown but encompasses any variant execution thereof.

In particular, the slots in the guide means could be part of the printing plate support block, rather than part of the applicator head, in which case the associated rollers would be on the applicator head.

It also goes without saying that the printing machine of the invention can be a separate entity used on its own or one printing station of a more complex printing machine.

There is claimed:

1. A printing machine for metallic foil printing comprising:

a support block for supporting a mobile printing plate for movement relative to an object support for supporting an object to be printed, said support block having a curved surface;

said mobile printing plate being arranged to apply a foil against an object to be printed, said printing plate being cooperable with the curved surface of the supporting block, said printing plate having a curvature corresponding to that of the curved surface in cooperable position with said supporting block;

an applicator head mounted for transverse movement relative to the object support; and said support block and said printing plate supported thereon being mounted for rocking movement on the applicator head, about a non-fixed imaginary axis, for rolling the foil along an object to be printed.

2. Printing machine according to claim 1, further comprising guide means for guiding the rocking movement of said support block operatively disposed between said support block and said applicator head.

3. Printing machine according to claim 2, wherein said guide means comprise curved slots and rollers cooperable with said slots.

4. Printing machine according to claim 3, wherein said rollers are provided on said support block and said slots are provided on said applicator head.

5. Printing machine according to claim 1, wherein said support block includes a heater plate.

6. Printing machine according to claim 5, wherein said support block comprises a normally non-removable part incorporating said heater plate and a removable part for carrying said printing plate.

7. Printing machine according to claim 5, wherein said heater plate is of flat configuration.

8. Printing machine according to claim 1, wherein said curved surface of said support block is part cylindrical with a circular contour and generatrices parallel to said object support.

9. A printing machine for metallic foil printing comprising:

a support block for supporting a mobile printing plate for movement relative to an object support for supporting an object to be printed, said support block having a curved surface;

said mobile printing plate being arranged to apply a foil against an object to be printed, said printing plate being cooperable with the curved surface of the supporting block, said printing plate having a curvature corresponding to that of the curved surface in cooperable position with said supporting block;

an applicator head mounted for transverse movement relative to the object support; and said support block and said printing plate supported thereon being mounted for rocking movement on the applicator head for applying the foil to an object to be printed, guide means for guiding the rocking movement of said support block operatively disposed between said support block and said applicator head, said guide means comprising curved slots and rollers cooperable with said slots, said applicator head including two parallel flanges, said support block being arranged for movement between said flanges, said flanges having two spaced said curved slots, a plate attached to said support block, two pairs of said rollers being rotatably mounted on said plate, each of said rollers being cooperable with a respective one of said slots.

10. Printing machine according to claim 9, wherein two said slots are defined in each of said flanges and arranged back to back.

11. Printing machine according to claim 9, wherein said slots have concave edges facing in a direction away from said object support.

12. Printing machine for metallic foil printing comprising:

a support block for supporting a mobile printing plate for movement relative to an object support for supporting an object to be printed, said support block having a curved surface;

said mobile printing plate being arranged to apply a foil against an object to be printed, said printing plate being cooperable with the curved surface of the supporting block, said printing plate having a curvature corresponding to that of the curved surface in cooperable position with said supporting block;

an applicator head mounted for transverse movement relative to the object support; and said support block and said printing plate supported thereon being mounted for rocking movement on the applicator head for applying the foil to an object to be printed, further comprising an arm attached to said support block, and a double acting actuator coupled to said arm for oscillation of said support block on said applicator head.

* * * * *